US006432003B1

(12) United States Patent
van Nimwegen

(10) Patent No.: US 6,432,003 B1
(45) Date of Patent: Aug. 13, 2002

(54) ADJUSTABLE WHEEL ENGAGEMENT ASSEMBLY FOR BASKETBALL GOAL SYSTEMS

(75) Inventor: Edward G. van Nimwegen, North Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 09/638,529

(22) Filed: Aug. 14, 2000

Related U.S. Application Data

(63) Continuation-in-part of application No. 09/249,275, filed on Feb. 11, 1999.

(51) Int. Cl.[7] ..... A63B 63/08
(52) U.S. Cl. ..... 473/481; 473/479
(58) Field of Search ..... 473/415, 436, 473/433, 481, 472, 479

(56) References Cited

U.S. PATENT DOCUMENTS

| | | | | |
|---|---|---|---|---|
| 3,650,530 | A | | 3/1972 | Gantz |
| 3,716,234 | A | | 2/1973 | Lancellotti |
| 5,112,407 | A | | 5/1992 | Sakai et al. |
| 5,207,407 | A | | 5/1993 | Fitzsimmons et al. |
| 5,248,140 | A | | 9/1993 | Matherne et al. |
| 5,259,612 | A | | 11/1993 | Matherne et al. |
| 5,415,393 | A | | 5/1995 | Fitzsimmons et al. |
| 5,518,233 | A | | 5/1996 | Williams |
| 5,542,679 | A | | 8/1996 | Caso |
| 5,571,229 | A | | 11/1996 | Fitzsimmons et al. |
| 5,836,838 | A | | 11/1998 | Van Nimwegen et al. |
| 6,001,034 | A | * | 12/1999 | Schickert et al. ..... 473/472 |

* cited by examiner

*Primary Examiner*—Paul T. Sewell
*Assistant Examiner*—M. Chambers
(74) *Attorney, Agent, or Firm*—Workman, Nydegger & Seeley

(57) ABSTRACT

A portable basketball goal system having an adjustable wheel assembly is disclosed. The portable basketball goal system may comprise a rigid pole, a support base, an adjustable wheel assembly, and an engaging member. The support base is configured to maintain the rigid pole in a generally elevated position. The adjustable wheel assembly is connected to the support base and has an engaged and disengaged position. In the engaged position, the wheel assembly supportably engages a playing surface. In the disengage position the wheel assembly may not supportably engage the playing surface. The adjustable wheel assembly may be slidably coupled to the support base. The adjustable wheel assembly may be operated by an engaging member coupled to a cam surface. The cam surface may interact with a follower to transition the adjustable wheel assembly between the supportable and unsupportable engagements.

34 Claims, 5 Drawing Sheets

ADJUSTABLE WHEEL ENGAGEMENT ASSEMBLY FOR BASKETBALL GOAL SYSTEMS

RELATED APPLICATION

This application is a continuation-in-part of my co-pending application, Ser. No. 09/249,275, filed on Feb. 11, 1999, and entitled PORTABLE BASKETBALL GOAL SYSTEM HAVING TWO-PART BASE SUPPORT ASSEMBLY, which is incorporated herein by reference.

BACKGROUND

1. The Field of the Invention

The present invention relates to basketball goal assemblies and, more particularly, to novel adjustable wheel engagement assemblies for basketball goal systems employing a unique structural design that facilitates selective movement of the basketball goal system in relation to a playing surface.

2. The Relevant Technology

As the game of basketball has increased in popularity a greater number of people have purchased basketball goals for use at their homes. Typically, home basketball goals are permanently mounted in a manner such that the driveway of the home serves as a playable basketball court, as few homes have sufficient land surrounding the home to dedicate space for exclusive use as a basketball court. In some instances, deciding where to position or mount a basketball goal can pose some playing difficulties. For example, mounting a basketball goal adjacent to the driveway of a home may precipitate a risk to any traffic in the driveway, resulting in potential injury to the players or damage to parked or moving automobiles.

In some cases, the perfect location for mounting a basketball goal is the place where permanently mounting the basketball goal cannot be easily accomplished. Such a location may be where there is concrete or asphalt on the ground. To permanently mount the basketball goal assembly would therefore require breaking up the concrete or asphalt and then repairing the receiving hole after inserting an end of a support pole into the ground. Such a procedure could be relatively expensive and would most likely leave the driveway appearing unsightly at least during the period of construction and repair.

Other disadvantages are also associated with permanently installed basketball goal assemblies. Since basketball goal assemblies are generally mounted to a surface outdoors, they are generally exposed to the harsh elements of the weather throughout the entire year. As appreciated, constant exposure to the elements of the weather (e.g., rain, snow, sleet, high temperatures) will typically cause the component parts of the basketball goal assembly to prematurely wear by promoting oxidation. Premature oxidation can be particularly troublesome in basketball goal assemblies having any moving parts, such as height adjustment mechanisms or breakaway rim assemblies. Moreover, consistent exposure to the elements of the weather may cause premature failure of such mechanisms.

Mounted basketball goal assemblies that are utilized in an indoor environment may suffer from similar disadvantages associated with permanent placement. For example, schools typically have a gymnasium which generally serves many functional purposes. Having several basketball goals permanently mounted for use in the gymnasium may preclude, or at least interfere, with certain other activities. On formal occasions, objection may be made to the appearance of one or more permanently mounted basketball goals.

In response to these and other disadvantages inherent in basketball goal assemblies that are permanently mounted to a surface, those skilled in the art began developing portable basketball assemblies. In order for a portable basketball goal assembly to be effective, sufficient weight must be employed to maintain the basketball goal in a generally rigid, upright position for use when playing the game of basketball or shooting baskets. Hence, portable basketball goal assemblies were developed utilizing a great deal of weight at the base, thereby making the goal assembly particularly difficult to move and typically requiring the assistance of several people to set up or relocate the basketball goal. Additionally, such designs can be prohibitively expensive for people desiring to purchase one for home use.

Other prior art portable basketball goal assemblies were developed which incorporate removable weights such as, for example, sand bags or metal weights, that are generally disposed in relation to the support structure. A principal disadvantage in using these types of removable weights is that they can be extremely heavy, difficult to lift and arrange. Accordingly, although the basketball goal assemblies employing such designs may be easier to move in relation to permanently mounted goal assemblies, the weights or weighted members are not.

In an attempt to make portable basketball goal assemblies that are better suited for home use, support bases were developed having a hollow cavity sufficient for receiving a ballast material. The ballast material introduced into the cavity of the support base may include water, sand or other suitable material. Such portable basketball goal assemblies can be more easily moved to a desired location where the support base is then filled with the ballast material, thereby providing sufficient weight to maintain the goal in a generally rigid, upright position for game play. A principal advantage of using a support base fillable with a ballast material is that water, sand or other fillable materials are usually inexpensive and convenient to use. When it is desired to move these prior art portable basketball goal assemblies, the ballast material is generally emptied out of the internal cavity in the support base and then the basketball goal assembly is moved. However, having to fill and empty the goal each time the goal is to be set up or moved requires time and is inherently inconvenient.

To assist in moving prior art basketball goal assemblies, one or more wheels were incorporated into support bases to facilitate movement of the basketball goal assembly. For example, one such wheeled support base design is disclosed wherein the support base generally engages the ground and rests on one or more base wheels. Movement is achieved by lifting and tilting the support base generally on an end until substantially the weight of the base rests on the wheels. Thus, the base wheels serve as a rotating fulcrum upon which the effective weight of the basketball goal assembly may be supported such that the basketball goal assembly then is maneuverable in this position from place to place.

A disadvantage to prior art base support wheel assemblies is that pivoting a heavy base to facilitate its relocation can be difficult for some people and especially for children to move. Specifically, attempting to pivot a heavy support base may present dangers associated with having the entire basketball goal assembly dropped on one or more persons or children. This is especially true when someone without sufficient physical strength attempts to pivot or move a heavy support base. Whereas, a sudden release of the heavy base can cause bodily injury or damage to the base or those in its vicinity.

In addition, many portable basketball goal assemblies do not fully engage the playing surface when positioned for game play. This is particularly problematic for basketball goal assemblies that incorporate wheels in the support base. For example, a portion of the base must be lifted off the playing surface to keep the basketball goal assembly from resting on the wheels and being somewhat moveable under little force. As a result, there is less friction between the support base and the playing surface, therefore the support base is liable to move during play, especially during slain dunks and other maneuvers that place a substantial lateral force on the basketball coal assembly.

Another disadvantage with prior art portable basketball goal assemblies is that many are formed having the support pole positioned only a few inches from the inner edge of the base. As a result, the moveable support base extends outwardly and underneath the basketball net. This makes it difficult to execute game play strategies in which a player is positioned behind or beneath the basketball net because the support base extends into this area of game play, and may even cause a player to stumble.

Moreover, many prior art portable basketball goal assemblies do not permit lateral (sideways) motion of the front portion of the support base. Thus, anyone attempting to move the heavy support base and attached pole and basketball goal support must intuitively push the assembly backward to move it or, alternatively, swing the rear portion of the support base around in an effort to orient the base before attempting to move the basketball goal assembly. This can be particularly troublesome when the basketball goal assembly is to be stored in a narrow enclosure; there may not be sufficient room to pivot the support base in order to remove the basketball goal assembly from the enclosure. As appreciated, small adjustments in the positioning of these type of prior art basketball goal assemblies for game play are generally more difficult if the front portion of the assembly, which supports the basketball goal, does not the capacity to be moved laterally.

Furthermore, many prior art portable basketball goal assemblies cannot be manipulated from a stationary configuration to a mobile configuration without changing the position of the device (i.e., forceably tilting the support base). This makes minor repositioning even more difficult, as a user must attempt to move the support base and then try to (guess where the base will end up after the basketball goal assembly is returned to a stationary configuration. A user may thus find it exceptionally difficult to move these prior art basketball goal assemblies only an inch or two.

As noted above, some of the prior art designs of portable basketball goal assemblies also have a number of other problems. For example, some have portions that protrude from the support base and thereby create a playing hazard. Others have moving parts that may pinch body parts as they fold or collapse together. Many prior art designs of portable basketball goal assemblies are also overly expensive and difficult to assemble because they require the use of special fixtures such as bearings, collars, and the like to retain metal parts such as wheels, posts, and sliding members in engagement with the support base.

Consistent with the foregoing, it would be an advancement in the art to provide an improved support base for portable basketball goal assemblies that can be easily moved by one person without having to pivot a significant portion of the weight of the support base in order to facilitate movement. It would be a further advancement in the art to provide a novel support base and wheel system for basketball goal assemblies that can be readily adapted into a playing position, thereby being, resistant to movement during game play.

Yet further, it would be an advancement in the art to provide a portable basketball goal system that is readily movable, as described above, in which substantially the entire underside of the base rests upon the playing surface during game play, so as to impart additional stability and resistance to forces acting on the basketball goal assembly which may tend to move the assembly when configured in the playing position. A still further advancement over the prior art devices would provided by such a basketball goal system wherein the support base does not extend underneath the basketball net, thus impeding net play or causing potential injury to one or more players.

It would be a further advancement in the art to provide a portable basketball goal assembly having a front portion that could be easily moved in a lateral direction. Furthermore, an advancement would be provided by a portable basketball goal assembly that could be made mobile without having to significantly shift the weight of the assembly for movement, so that minor positioning adjustments may easily be made. Further advancements in the art may stem from providing a support base that is substantially free from protruding objects or members that may impede normal use or game play, and substantially free from folding or compressing areas accessible to a user. Still further advancements in the art would be to provide a basketball goal assembly in which comparatively few fixtures are required to retain moving or assembled parts within the support base.

Such a device is disclosed and claimed herein.

BRIEF SUMMARY OF THE INVENTION

The present invention is directed to a basketball goal system employing a novel adjustable wheel engagement assembly that facilitates movement of the basketball goal system relative to a playing surface. One presently preferred embodiment of the novel basketball goal system of the present invention comprises a rigid support pole having a first end configured to supportably engage a basketball goal above a playing surface and a second opposing end adapted to engage a movable support base, The support base may include a receiving aperture formed in a first portion of the support base, wherein the receiving aperture is adapted to receive and maintain the second end of the support pole in either a fixed or pivotal relationship thereto. The support base further includes sufficient weight appropriately disposed along its dimensional length and width so as to support the rigid support pole and the basketball goal in a general upright position over a playing surface for game play.

In one presently preferred embodiment, an adjustable wheel assembly is operably disposed proximate the front portion of the support base having the receiving aperture for receiving the support pole. Preferably, the adjustable wheel assembly comprises a caster rotatably disposed in relation to a support assembly. As will be appreciated, one or more rollers may be supportably disposed in relation to the support base between the front portion and the back portion of the base, if desired. In one presently preferred embodiment of the present invention, the adjustable wheel assembly and one or more rollers, in combination, may provide sufficient support to the base to allow for selective maneuvering of the basketball goal system to various locations for either game play or storage.

An engaging member, moveable between an extended position and a retracted position, is disposed in operable engagement to the support pole. In one presently preferred embodiment, the engaging member comprises a proximal end pivotally connected to the second end of the support pole contiguous the front portion of the base and proximate the receiving aperture that receives the support pole. The engaging member further comprising a distal end configured to engageably receive a hand of a user (e.g., forming a handle). Preferably, the engaging member is pivotally engages the support pole such that the engaging member may be selectively pivoted between an extended position wherein the distal end of the engaging member extends substantially outward and at an angle relative to the generally upright disposition of the support pole and a retracted position wherein the distal end of the engaging member extends substantially parallel to the disposition of the support pole positioned for game play.

In one presently preferred embodiment, the adjustable wheel assembly may comprise a caster mounted on a slider that selectively extends outward from a hollow channel formed at the second end of the support pole. The distal end of the engaging member may include a cam adjustment surface designed to rest upon a follower that is attached to the slider. In operation, the rotational positioning of the cain adjustment surface, when selectively pivoting the engaging member between the retracted position and the extended position, subsequently controls the vertical position of the follower, and therefore that of the slider.

As noted above, in the retracted position, the engaging member is generally disposed substantially upward and parallel to the disposition of the support pole. In operation, the cam adjustment surface of the engaging member may be pivoted in such a way that the follower remains in an upward position. Consequently, the slider of the adjustable wheel assembly may be retained within the internal periphery of the hollow chamber of the support pole, and the caster may therefore be retracted such that the weight of the basketball goal system does not rest upon the adjustable wheel assembly, but rather on the contacting surface of the base support to prevent movement of the basketball goal system. Although one or more rollers may remain in constant contact with the playing surface, the rollers alone are ineffective to allow movement of the support base from one location to another when the engaging member is selectively positioned in the retracted position. Significant movement of the basketball goal system is thus prevented during game play when the engaging member is disposed in the retracted position and the caster is selectively retracted from supporting engagement with the playing surface.

In the extended position, the engaging member extends substantially outward and at an angle relative to the generally upright disposition of the support pole for game play. In operation, the cam adjustment surface of the engaging member may be rotated to a position in which the follower is forced generally downward in relation to the support base. Consequently, the slider generally slides outward from within the hollow channel at the second end of the support pole and, as the caster supportably engages the playing surface, the front portion of the support base is subsequently lifted off the playing surface so that the weight of the front portion of the support base supportably rests upon the caster of the adjustable wheel assembly. As noted above, the distal end of the engaging member may then used as a handle or lever for gripping in order to facilitate maneuvering of the support base and, accordingly, the basketball goal system from one location to another for game play or storage.

Thus, it is an object of the present invention to provide a novel adjustable wheel assembly for a basketball goal system having an engaging member adapted to be selectively positionable between a retracted position such that the support base is restricted from significant movement in relation to the playing surface and an extended position which facilitates controlled movement of the support base and, correspondingly, the basketball goal system from one location to another.

It is an additional object of the present invention to provide a support base for a basketball goal assembly that may be moved from one location to another without having to physically lift or tilt the support base from its substantially horizontal position relative to the playing surface.

It is a further object of the present invention to provide a basketball goal system having an engaging member comprising a distal end that serves as a handle or lever for gripping by a user when attempting to manually maneuver the basketball goal system from one position to another.

It is a still further object of the present invention to provide a novel adjustable wheel assembly for basketball goal systems that maintains a substantial frictional area between the support base and the playing surface for stable game play when the engaging member is disposed in a retracted position and, correspondingly, a significant portion of the length of the slider is selectively disposed in the hollow channel formed in the second end of the support pole.

Additionally, it is an object of the present invention to provide a support base for a basketball goal system that remains substantially displaced from beneath a basketball net to make net play safer and easier.

It is also an object of the present invention to provide a support base for a basketball goal system, wherein a front portion of the support base can be moved in a lateral direction by means of displacing the engaging member in an extended position, thus disposing the caster of the adjustable wheel assembly in supportable relation to the playing surface so as to facilitate easy maneuvering of the basketball goal assembly from one location to another.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
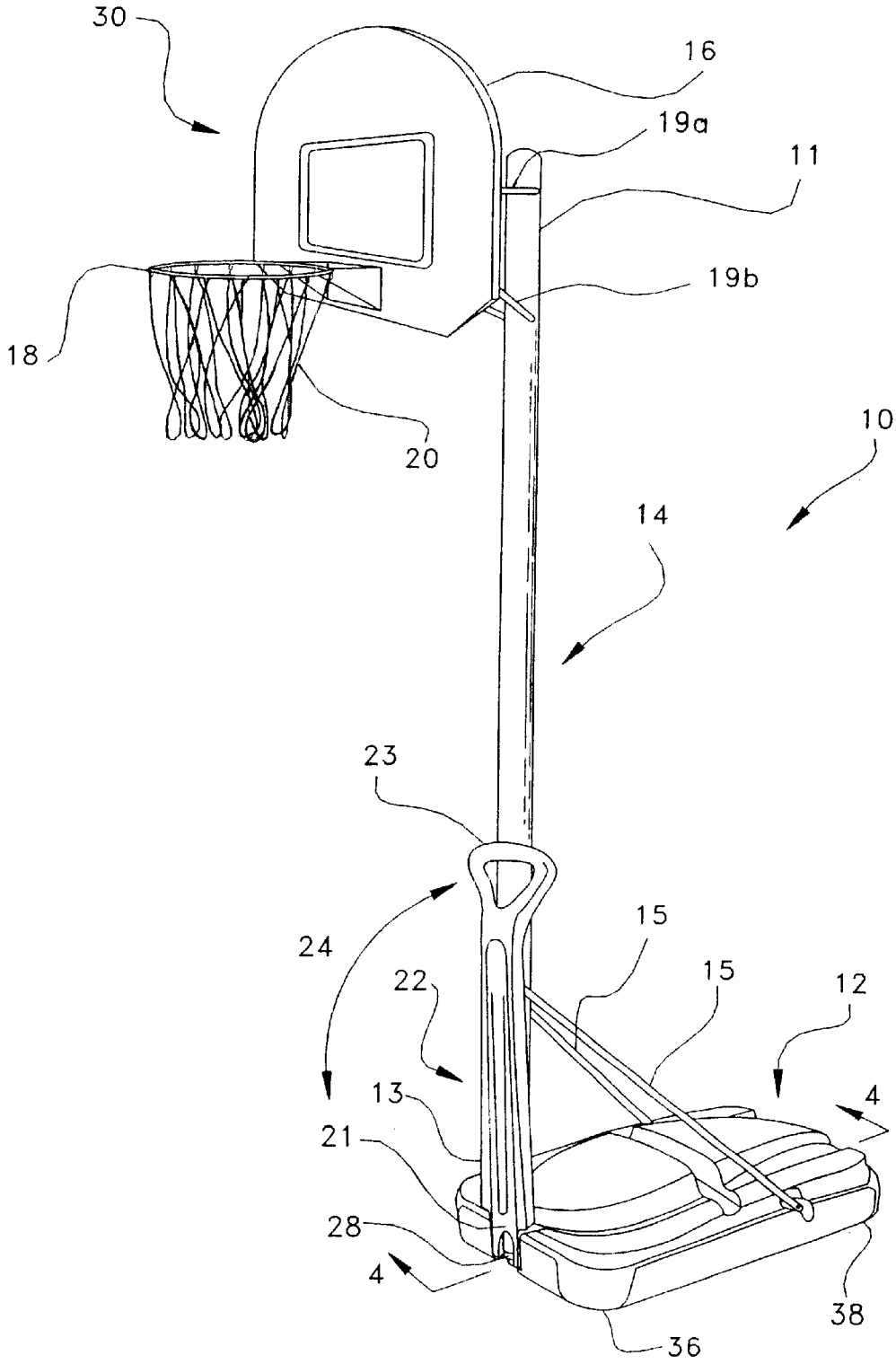
FIG. 1 is a perspective view of one presently preferred embodiment of a basketball goal system in accordance with the present invention.
Figure 2:
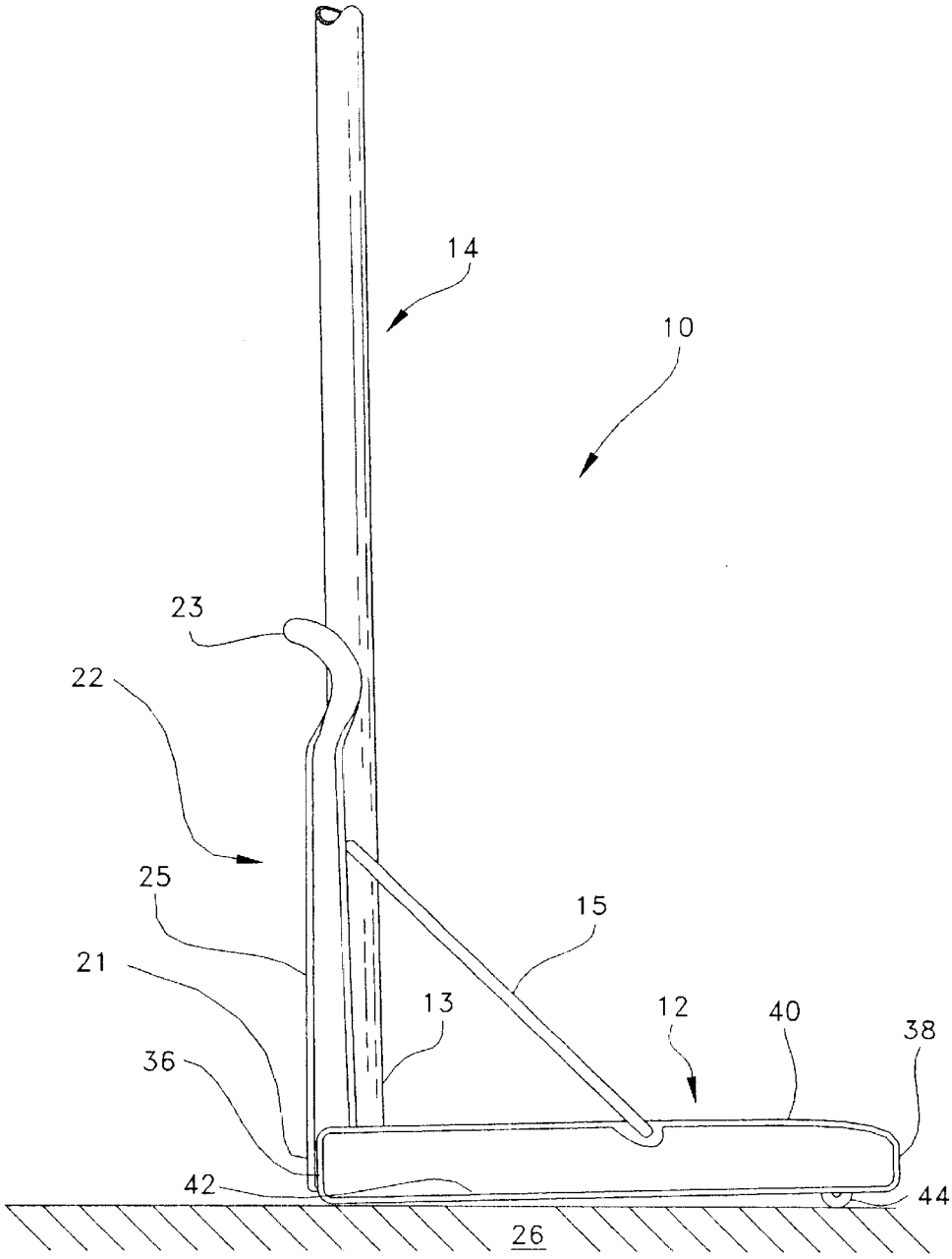
FIG. 2 is a side view of the embodiment of the basketball goal system of FIG. 1 illustrating a support pole, a support base, and an extending member, wherein the basketball goal system is disposed in a stationary configuration for game play.

One presently preferred embodiment of the present invention, designated generally at 10, is best illustrated in FIGS. 1 and 2. As shown, the basketball goal system 10 comprises a rigid support pole 14 having a first end 13 configured to supportably engage a basketball goal assembly 30 above a playing surface 26 and a second opposing end 13 adapted to mountably engage a support base 12. Structurally, the support base 12 includes a receiving aperture 28 formed in a front portion 36 of the support base 12, wherein the receiving aperture 28 is adapted to receive and maintain the opposing second end 13 of the support pole 14 in either a fixed or pivotal relationship to the base 12. The support base 12 preferably comprises sufficient weight so as to support the pole 14 and the basketball goal assembly 30 in a general upright position over a playing surface 26. In addition, one or more brace supports 15 may have opposing ends adapted to provide a structural connection between the support base 12 and the pole 14 so as to assist in providing structural support to retain the support pole 14 and the attached basketball goal assembly 30 in a generally upright configuration for game play.

In one presently preferred embodiment, the basketball goal assembly 30 may include a backboard 16, a rim 18, a net 20, and upper and/or lower engagement arms 19*a,* 19*b* pivotally connected between the basketball backboard 16 and the first end 11 of the support pole 14. As contemplated herein, an adjustment assembly (not shown) may be operably disposed in relation to the upper and/or lower engagement arms 19*a,* 19*b* of the basketball goal assembly 30 such that selective manipulation of the adjustment assembly results in a corresponding adjustment in the height of the basketball goal assembly 30 above the playing surface 26.

The support base 12 of the present invention is preferably formed of a substantially sturdy, rigid material. For example, the support base 12 may be formed of a polymeric material such as, for example, a low-density linear polyethylene. It will be readily appreciated by those skilled in the art, however, that a wide variety of other suitable materials such as wood, fiberglass, ceramic, any of numerous organic, synthetic or processed materials which are mostly thermoplastic or thermosetting polymers of high molecular weight, and/or other composite or polymeric materials are possible which are consistent with the spirit and scope of the present invention.

The support pole 14 is preferably constructed of a rigid material having comparatively high resistance to impact and yielding. Although certain plastics and polymers may be used, the support pole 14 of one presently preferred embodiment of the present invention is formed of metal, such as steel or aluminum, or of a sufficiently sturdy composite material. It will be readily appreciated by those skilled in the art that the support pole 14 of the present invention may comprise two or more sectional members that can be assembled together to form a single support pole having sufficient structural integrity so as to support a goal support assembly 30 above a playing surface 26. For example, the support pole 14 may include two or more sectional members that telescopically engage each other to provide a single support pole 14.

Figure 4:
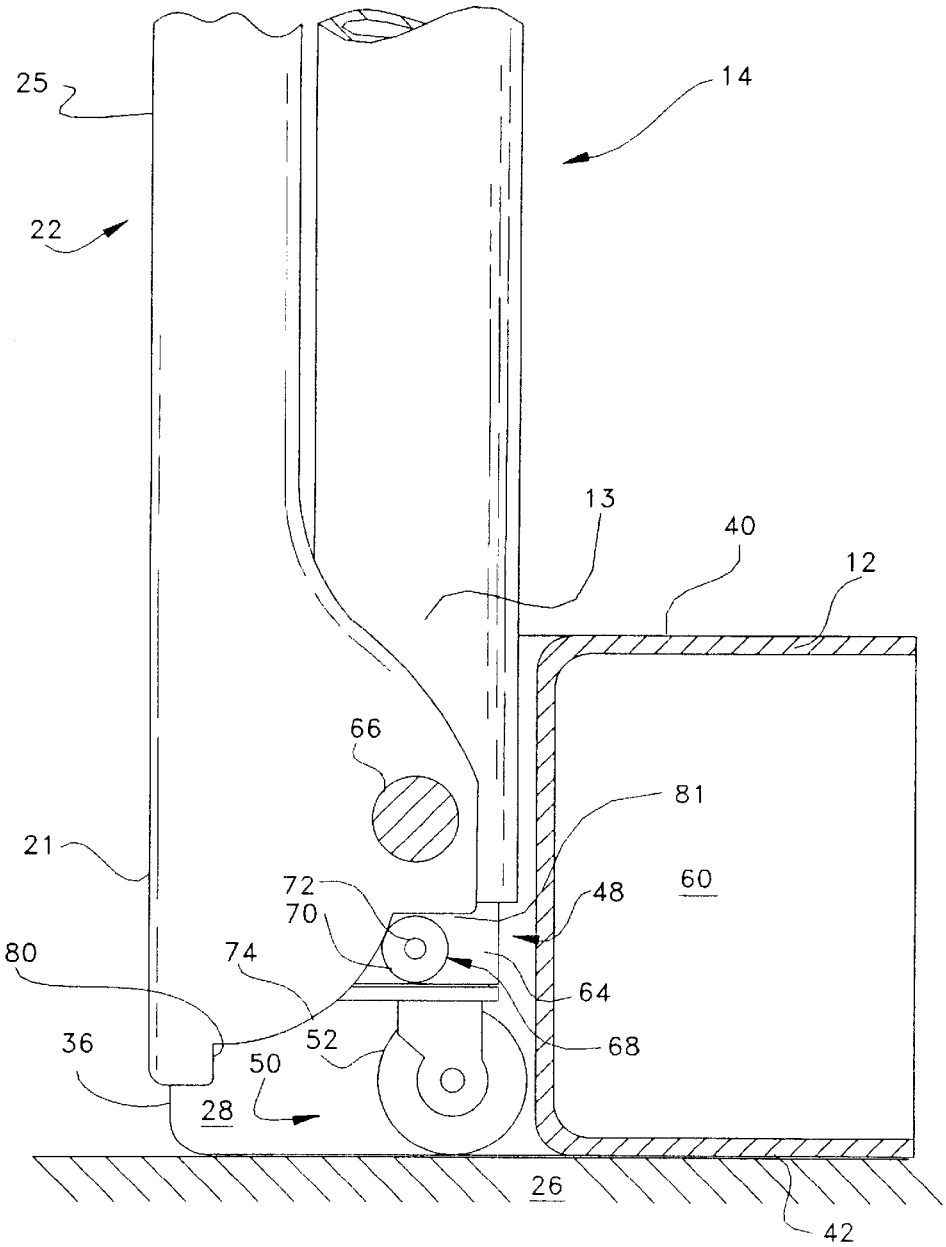
FIG. 4 is an exploded, cross-sectional, side view of a front portion of the support base illustrating the pivotal relationship of the extending member and the adjustable wheel assembly of the embodiment of the basketball goal system of FIG. 1, wherein a contacting surface of the support base remains in frictional contact with the playing surface to prevent movement of the basketball goal system.
Figure 5:
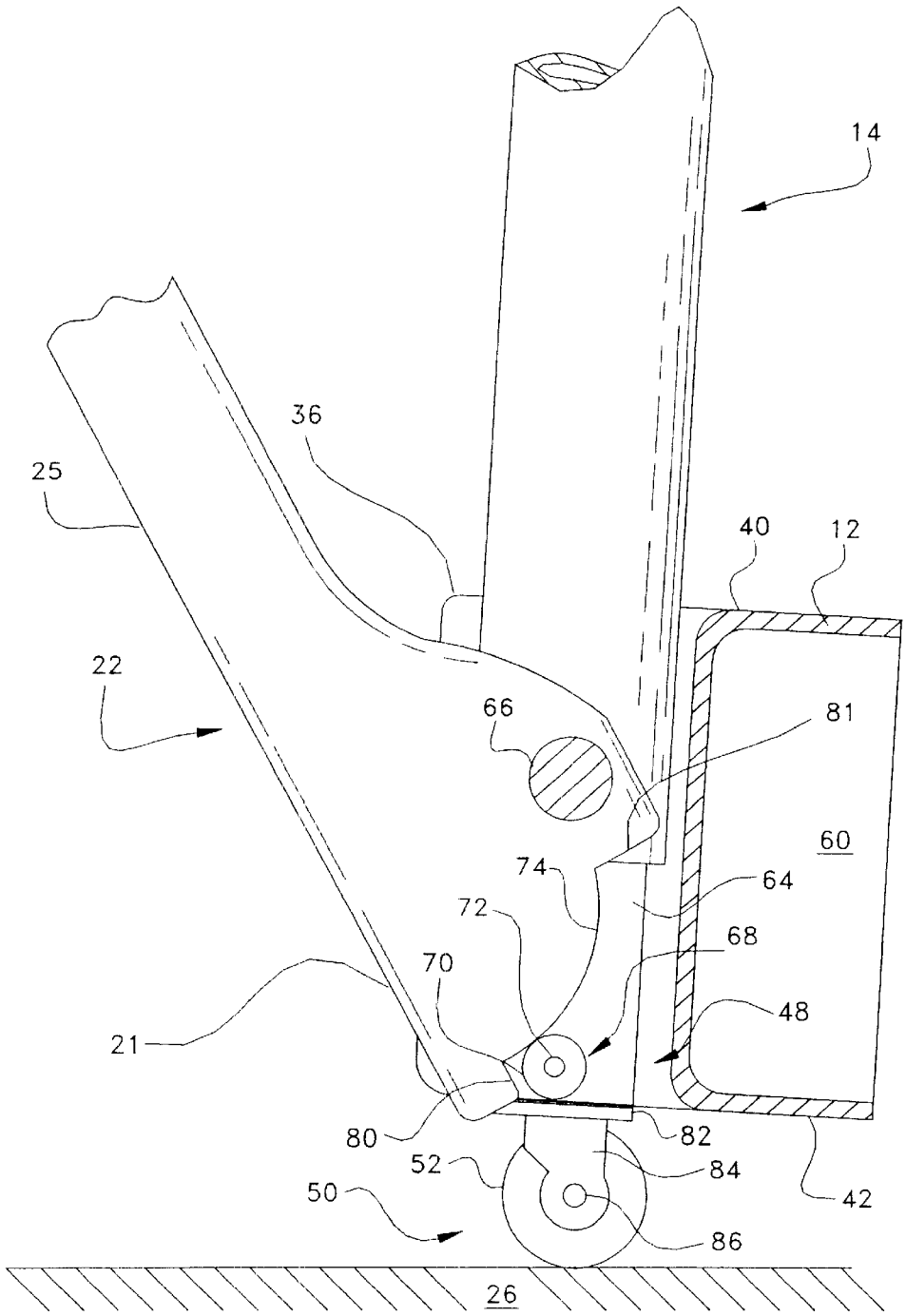
FIG. 5 is an exploded, cross-sectional, side view of the front portion of the support base illustrating the structural relationship between the cam surface of the engaging member and the follower attached to the slider of the adjustable wheel assembly of the embodiment of the basketball goal system of FIG. 1, wherein the slider slidably extends outwardly from its telescopic engagement with the second end of the support pole and thereby positions the caster in supportable relation to the playing surface so as to lift a portion of the contacting surface of the support base from its frictional engagement with the playing surface so as to allow for easy transportation of the basketball goal system from one location to another.

Referring now to FIGS. 4 and 5, in one presently preferred embodiment of the present invention, the support base 12 is formed having a cavity 60 having an internal periphery sufficient for receiving a ballast material such as, for example, water, sand, or the like. In operation, the ballast material provides sufficient weight and adequate support to retain the support pole 14 and the basketball goal assembly 30 in a general upright position during rigorous game play. In such an embodiment, the support base 12 may be configured with an opening (not shown) formed in the upper surface 40 of the support base 12 such that when the base 12 is filled, for example, with water to the point that the water level in the support base 12 reaches the opening, a void remains within the upper portion of the cavity 60 which does not fill with water. This is to allow for expansion of the water in the case of freezing temperatures.

In operation, after introducing the ballast material into the internal periphery of the cavity 60 of the support base 12, a closure or cap (not shown) may be secured in the face of the opening, to prevent the displacement of the ballast material from the cavity 60 of the support base 12. As will be appreciated, the support base 12 may not include a cavity 60 for introducing a ballast material, but rather comprise sufficient weight, in and of itself to ensure the stability of the basketball goal system 10 when the support pole 14 and the attached basketball goal assembly 30 are disposed generally upward from the playing surface 26 for game play.

Referring back to FIGS. 1 and 2, in one presently preferred embodiment, the support base 12 comprises a front portion 36, a rear portion 38, an upper surface 40, and a contacting surface 42. The receiving aperture 28 of the support base 12, which receives and maintains the second end 13 of the support pole 14 in fixed or pivotal relation thereto, is preferably formed within the front portion 36 of the support base 12. The engagement between the support pole 14 and the receiving aperture 28 of the support base 12 may include a cross-brace member 66 (e.g., a linear shaft or axle) having a proximate end, a distal end, and an intermediate body portion formed between the proximate and distal ends thereof. In this regard, the proximate end of the cross-brace member 66 may be engageably disposed in relation to the support base 12 and the distal end of the cross-brace member 66 engageably disposed in relation to the support pole 14.

In one presently preferred embodiment of the present invention, a first and second cross-brace member 66 are formed on opposite sides of the support pole 14, thus engaging opposite sides of the receiving aperture 28 of the support base 12, as best shown in FIGS. 4 and 5. It will be readily apparent to those skilled in the art that other mechanisms may be constructed in accordance with the inventive principles set forth herein so as to facilitate a fixed or pivotal connection between the support pole 14 and the support base 12. It is intended, therefore, that the example provided herein be viewed as exemplary of the principles of the present invention, and not as restrictive to a particular structure for implementing those principles.

Figure 3:
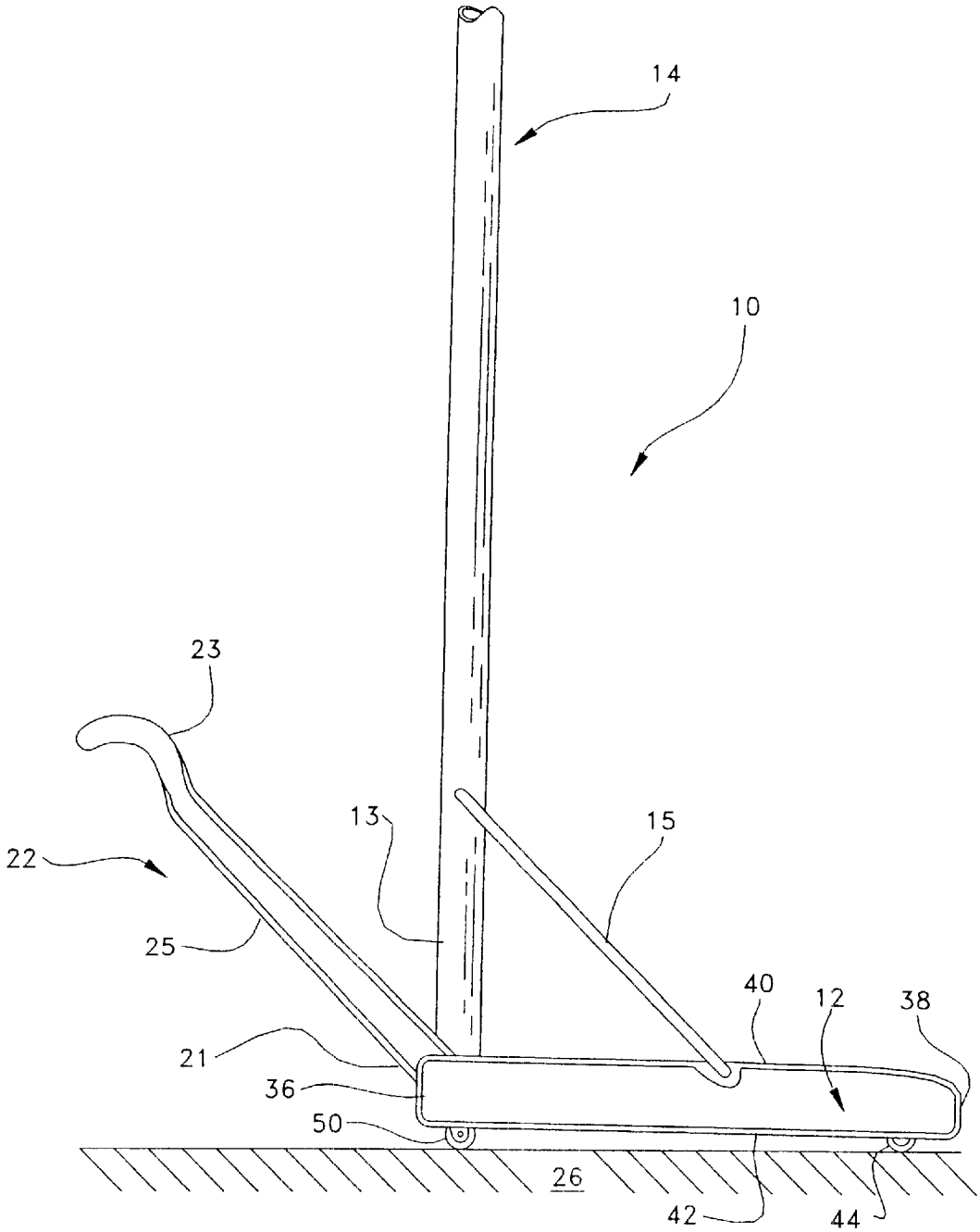
FIG. 3 is a side view of the embodiment of the basketball goal system of FIG. 1 illustrating an engaging member disposed in an extended position and an adjustable wheel assembly supportably engaging the playing surface, wherein facilitating selective movement of the basketball goal system from one location to another.

Also disposed in relation to the cross-brace member 66 is an engaging member 22. As best illustrated in FIGS. 1–3, the engaging member 22, being selectively moveable between an extended position and a retracted position so as to define an adjustable distance 24 therebetween, is disposed in pivotal engagement to the support pole 14 by means of one or more cross-brace members 66. In one presently preferred embodiment, the engaging member 22 comprises a proximate end 21 pivotally connected to the second end 13 of the support pole 14 contiguous the front portion 36 of the support base 12 and proximate the receiving aperture 28 which structurally receives the support pole 14 in relation to the base 12. The engaging member 22 also includes a distal end 23 and an elongate intermediate body portion 25 formed between the proximal and distal ends 21, 23 thereof. The distal 23 of the engaging member 22 is preferably configured to receive a hand of a user (e.g., forming a handle) to assist in maneuvering the basketball goal system 10 from one position to another when the engaging member 22 is positioned in the extended position.

As noted above, the engaging member 22 is structurally disposed relative to the rigid support pole 14 and the base 12 in such a manner that the engaging member 22 may be selectively pivoted between an extended position wherein the distal end 23 of the engaging member 22 may extend substantially outward and at an angle relative to the support pole 14 (as shown in FIGS. 3 and 5) and a retracted position such that the distal end 23 of the engaging member 22 may be positioned substantially parallel to the generally upright disposition of the support pole 14 (as shown in FIGS. 1, 2, and 4). When the engaging member 22 is positioned in the extended position, an adjustable wheel assembly 50 is operably disposed into supportable engagement with the playing surface 26 such that the front portion 36 and at least a portion of the contacting surface 42 of the support base 12 is lifted from its frictional engagement with the playing surface, thereby allowing the basketball goal system 10 to be moved from one location to another. In contrast, when the engaging member 22 is positioned in the retracted position, the adjustable wheel assembly 50 is retracted from supportable engagement with the playing surface 26 such that tile contacting surface 42 of the support base 12 remains in fictional engagement with the playing surface, thus restricting movement of the support base 12 and, correspondingly, the basketball goal system 10.

Referring, now to FIG. 2, one presently preferred embodiment of the support base 12 includes a contacting surface 42 that may be formed having a slight slope upward gently toward the back portion 38 of the support base 12 to expose a roller 44 supportably engaging a portion of the contacting surface 42. Preferably, a portion of the roller 44 remains in substantial communication with the playing surface 26 when the support base 12 is in the playing position. As will be appreciated, one or more rollers 44 may be supportably disposed in relation to the support base 12 at various positions between the front portion 36 and the back portion 38 of the support base, if desired, to assist in maneuvering the basketball goal system 10 when the engaging member 22 is selectively positioned in the extended position as shown in FIG. 3.

In one presently preferred embodiment, the roller 44 may comprise a caster or a single cylindrical wheel extending a sufficient length across the width of the support base 12 to assist with maneuvering of the support base 12 when the adjustable wheel assembly 50 is disposed in supportable relation to the playing surface 26. It is anticipated, therefore, that any arrangement of rollers is herein contemplated to be within the scope of the present invention, so long as the rollers, independent of the adjustable wheel assembly 50, cannot facilitate significant movement of the support base 12 without selectively disposing the engaging member 22 in the extended position, thus activating the supportable engagement of the adjustable wheel assembly 50 with the playing surface 26. Preferably, two or more cylindrical wheels 44 are rotatably disposed in relation to the contacting surface 42 of the support base 12 proximate the back portion 38 to provide additional maneuvering support to the support base 12 when engaging the adjustable wheel assembly 50 and thus moving the basketball goal system 10 from one location to another.

The rollers 44 preferably turn about axles that are mounted in at least a portion of the contacting surface 42 of the support base 12 and are thus configured to support translation of the support base 12 along an axis extending between the front and back portions 36, 38. The contacting surface 42, however, fictionally engages tie playing surface 26 at the front portion 36 of the support base 12, so that the support base 12 remains substantially immobile until the adjustable wheel assembly 50 is selectively positioned to supportably engage the playing surface 26. A substantial portion of the contacting surface 42 of the support base 12 therefore remains in frictional contact with the playing surface 26 to ensure that the basketball goal system 10 remains sufficiently stable even during rough game play. As best illustrated in FIGS. 1 and 2, the engaging member 22, when positioned in the retracted position, may be generally oriented substantially vertical in relation to the support base 12, and may further act as a rebound surface for a basketball during game play. In this regard, it will be appreciated by those skilled in the art that the intermediate body portion 25 of the engaging member 22 may be formed in geometrical configur ation or shape sufficient to provide a rebound surface for a basketball.

Referring now to FIGS. 3 and 5, when the extending member 22 in positioned in the extended position, the distal end 23 of the extending member 22 is disposed outwardly away from the generally upward direction of the support pole 14. Correspondingly, the adjustable wheel assembly 50 extends a length from its telescopic engagement with the second end 13 of the support pole 14, thereby supportably lifting the front portion 36 of the support base 12 from frictional engagement with the playing surface 26. In one presently preferred embodiment, the adjustable wheel assembly 50 comprises a caster 52 operably disposed in relation to a support assembly comprising a slider 64 having a dimensional length sufficient for selectively extending from a hollow channel formed at the second opposing end 13 of the support pole 14 when the engaging member 22 is positioned in the extended position. In structural relationship, the engaging member 22 preferably includes a cam adjustment surface 74 designed to rest upon a follower 68 that is operably attached to the slider 64 approximate a leading end thereof. In operation, the rotational position of the cam adjustment surface 74 determines the vertical positioning of the follower 68 along its length and therefore the corresponding vertical positioning of the slider 64 relative thereto, as best illustrated in FIGS. 4 and 5.

In one presently preferred embodiment of the present invention, the caster 52 engages a swivel base 82 rigidly connected to the leading end of the slider 64. The operable relationship between the caster 52 and the swivel base 82 supports multiple directions of movement so that the front portion 36 of the support base 12 can be oriented in a lateral direction by manual manipulation of the distal end 23 of the engaging member 22 (e.g., which preferably provides a handle for gripping by a user). Maneuvering the basketball goal system 10 by selectively positioning of the engaging member 22 in the extended position and thereby disposing the caster 52 of the adjustable wheel assembly 50 in supportable relationship with the playing surface 26 is thus intuitive and simple.

Preferably, the caster 52 is rotatably mounted at the leading end of the slider 64 of the adjustable wheel assembly 50. The caster 52 may comprise any configuration that permits rolling in several different directions. In one presently preferred embodiment of the adjustable wheel assembly 50, the caster 50 comprises a swivel base 82 affixed to the slider 64 to permit a full 360° of rotation about the axis of the support pole 14. An extension plate 84 may be mounted vertically, extending outwardly from engagement with the swivel base 82 to retain the caster 52 via an axle 86. The caster or wheel 52 is preferably horizontally displaced from the axis of the support pole 14, so that the caster 52 will align itself with a direction of motion of the front portion 36 of the base support 12. Thus, a user may pull on the distal end 23 of the engaging member 22 to move the basketball goal system 10 in a forward direction or, in the alternative, a user may apply a pushing force against the distal end 23 of the engaging member 22 to rotate the caster 52 and thereby induce lateral movement in the front portion 36 of the support and, accordingly, cause controlled movement of the basketball goal system 10 from a first location to second location.

In one presently preferred embodiment, the caster 52 may be configured to extend directly from the second end 13 of the support pole 14 so as to directly bear the weight of the pole 14. It will be appreciated, however, that the caster 52 may be formed off-set the support pole 14 in such a manner so as to sufficiently support the weight of the support pole 14 and the front portion 36 of the support base 12 supportably lifted from engagement with the underlying playing surface 26. It is intended, therefore, that the example provided herein be viewed as exemplary of the principles of the present invention, and not as restrictive to a particular structure for implementing those principles.

Referring to FIG. 4, a cross-sectional side view of the front portion 36 of the support base 12 of the basketball goal system 10 is illustrated as defined along lines "4—4" of FIG. 1. As shown, a receiving aperture 28 is preferably formed in the front portion 36 of the support base 12 and includes an internal periphery having a dimensional size and configuration sufficient to accommodate the second end 13 of the support pole 14 in fixed or pivotal engagement with the support base 12. The receiving aperture 28 may be formed separate from an internal cavity 60 also formed in the support base 12. The internal cavity 60 preferably comprises an internal dimensional periphery sufficient for holding a ballast material, as discussed above.

In one presently preferred embodiment, the support pole 14 pivotally engages the support base 12 by means of a shaft 66 that preferably extends into the support base 12 on either or both sides of the second end 13 of the support pole 14. The shaft 66 may terminate at one or both ends in a locking pin or shaped cap segment (not shown) designed to fit within a corresponding receiving slot (not shown) integrally formed in the front portion 36 of the support base 12 to restrict pivotal motion of the support pole 14 about the shaft 66. The receiving slot may be open on the upper surface 40 of the support base 12 to permit easy assembly of the pole 14 and the base 12 by way of introducing the shaft 66 into the receiving slot (not shown). The proximal end 21 of the engaging member 22 may also be pivotally mounted on the shaft 66, but is free to pivot about the shaft 66 independent the pivotal relationship of the support pole 14.

It will be appreciated that a follower 68 may be supportably mounted on one or both sides of the slider 64 to provide structural support between the support base 12 and proximate end 21 of the engaging member 22 when the basketball goal system 10 is being moved from one location to another. Moreover, the follower 68 may take any form or configuration suitable for variably engaging the contoured cam adjustment surface 74 of the engaging member 22. A simple smooth, rounded projection or knob may form the follower 68; however, in one presently preferred embodiment, a bearing 70 may be rotatably mounted on a hub 72 to provide smooth motion with a minimum of wear. As best illustrated in FIGS. 4 and 5, the outer contacting edges of the follower 68 engage the cam adjustment surface 74 formed at the proximal end 21 of the engaging member 22. The cam adjustment surface 74 preferably takes the form of a cam shaped to push the follower 68 to an extended position when the extending member 22 is positioned in the extended position, wherein the distal end 23 thereof is situated substantially outward and at an angle from the pole support 14, as best illustrated in FIG. 4.

Referring specifically now to FIG. 5, the cam adjustment surface 74 is reoriented to structurally encourage the slider 64 substantially outward a length from the second end 13 of the support pole 14 via the engagement between the follower 68 and the cam surface 74. As appreciated, the cam adjustment surface 74 must be properly contoured to ensure that a substantially consistent downward force on the follower 68 is maintained through the entire range of motion of the engaging member 22.

Referring back to FIGS. 4 and 5, a first structural stop 80 may be formed at the proximate end 21 of the engaging member 22 to engage the follower 68 and thereby provide a form of "capture" to prevent further extension of the engaging member 22 when positioned in the fully extended position. Alternatively, the engaging member 22 may function without the first structural stop 80 and this permit the engaging member to extend into a near horizontal position, if desired. A second structural stop 81 may be formed at the proximate end 21 of the engaging member 22 to engage the follower 68 and thereby provide a form of "capture" to prevent further extension of the engaging member 22 when disposed in the fully retracted position.

Consistent with the foregoing, the present invention provides a novel basketball goal system 10 having a support base 12 which is moveable without having to physically tilt the support base 12 and thereby support a significant portion of the overall weight of the basketball goal system 10. By selectively retracting the caster 52 of the adjustable wheel assembly 50 from supportable contact with the playing surface 26, maneuverability and operation of the support base 12 are facilitated and safety is therefore increased. The pivoting engaging member 22 serves to thereby restrict movement of the support base 12 by preventing contact of the caster 52 with the playing, surface 26. Moreover, the engaging member 22 may provide a handle to assist in movement of the basketball goal assembly 10 and a rebound surface for the basketball during game play, if desired.

Stability of the basketball goal system 10 during play is improved by selectively maintaining a substantial portion of the contacting surface 38 of the support base 12 in frictional contact with the playing surface 26 for game play. Movement of the basketball goal system 10 from one location to another is further simplified by the use of an adjustable wheel assembly 50 operably disposed in extendable relation to the second end 13 of the support pole 14 engageably received at the front portion 36 of the support base 12. The adjustable wheel assembly 50 comprises a caster 52 connected to a swivel base 82 which, in combination, permits the lateral movement of the front portion 36 of the support base 12 when the extending member 22 is positioned in the extended position. The incorporation of one or more rollers 44 in concert with the adjustable wheel assembly 50 facilitates controllable maneuverability of the basketball goal system 10 of the present invention from one location to another location. Moreover, the linear path of extension and retraction of the slider 64 and the caster 52 of the adjustable wheel assembly 50 enables supportable deployment of the caster 52 in relation to the playing surface 26 without substantially moving the basketball goal system 10, so that easy adjustments are possible.

In addition, the structural arrangement of the cam adjustment surface 74 and the follower 68 has a number of operative benefits. For example, the leverage involved enables a user to lift the considerable weight of the front portion 36 of the support base 12 (i.e., over an inch or more) with a comparatively small downward force acting on the engaging member 22. The cam adjustment surface 74 and the follower 68 are also enclosed within the receiving aperture 28, so that fingers or other extremities of a user may not be easily pinched, and no significant part protrudes horizontally outward from the support base 12 in any configuration so as to injure a user or impede storage of the basketball goal system 10.

The telescopic engagement between a length of the slider 64 and the second end 13 of the support pole 14 also imparts a number of distinct advantages to the present invention. For example, the mounting of the caster 52 on the slider 64 selectively disposed within hollow channel formed in the support pole 14 provides a more rigid connection than a fixture attached to a polymeric material, such as plastic, which may be used to form the support base 12. This structural arrangement between the caster 52 and the slider 64 of the adjustable wheel assembly 50 with the support pole 14 provides a sturdier basketball goal system 10 in which the greatest loads are carried by stronger, more rigid members. Manufacturing and assembly of the basketball goal system 10 is also simplified by reducing the number of metal fixtures that must be mounted in relation to the support base 12 to retain metal parts. Consequently, the basketball goal system 10 of the present invention may be manufactured with comparatively little expense and difficulty.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed and desired to be secured by United States Letters Patent is:

1. A portable basketball goal system, comprising:

a rigid pole configured to support of basketball goal above a playing surface;

a support base having a front portion, wherein the support base is adapted to receive and maintain said pole in a generally upward direction;

an adjustable wheel assembly disposed in relation to said support base, said wheel assembly being adjustable between and an engaged position such that the wheel assembly selectively engages said playing surface and a disengaged position such that the wheel assembly is removed from supportable engagement with the playing surface; and an engaging member pivotally connected to said support base, wherein said engaging member is configured to be positionable between an extended position such that said adjustable wheel assembly is correspondingly disposed in said engaged position to supportably remove said front portion of the support base from contact with said playing surface and a retracted position such that the adjustable wheel assembly is correspondingly disposed in said disengaged position wherein the front portion of the support base supportably engages the playing surface.

2. The portable basketball goal system as defined in claim 1, further comprising at least one roller rotatably coupled to the base support, wherein the roller is spaced apart from the adjustable wheel assembly.

3. The portable basketball goal system as defined in claim 1, wherein said pole comprises at least two section members adapted to be telescopically disposed in relation to each other.

4. The portable basketball goal system as defined in claim 1, wherein said pole comprises a first end supportably engaging said basketball goal and a second opposing end pivotally connected to said support base.

5. The portable basketball goal system as defined in claim 4, wherein said second end of said pole comprises an internal channel.

6. The portable basketball goal system as defined in claim 5, wherein said adjustable wheel assembly comprises a slider having a length and a leading end.

7. The portable basketball goal system as defined in claim 6, wherein said internal channel of said pole comprises an internal periphery configured for receiving a portion of said length of said slider.

8. The portable basketball goal system as defined in claim 6, wherein said adjustable wheel assembly further comprises a caster.

9. The portable basketball goal system as defined in claim 8, wherein said caster is disposed in relation to said leading end of said slider.

10. The portable basketball goal system as defined in claim 8, wherein said caster is mounted to a swivel base.

11. The portable basketball goal system as defined in claim 1, wherein said adjustable wheel assembly comprises a substantially straight path of extension and retraction.

12. The portable basketball goal system as defined in claim 1, wherein said adjustable wheel assembly is disposed beneath said pole to directly support a weight thereof.

13. The portable basketball goal system as defined in claim 1, wherein said engaging member comprises a proximate end, a distal end, and an intermediate body portion formed between said proximate and distal ends, said proximate end pivotally attached to said support base.

14. The portable basketball goal system as defined in claim 13, wherein said distal end of said engaging member comprises a handle.

15. The portable basketball goal system as defined in claim 13, wherein said engaging member actuates said adjustable wheel assembly into said disengaged position when said distal end of the engaging member is moved toward said pole, and wherein the engaging member actuates the adjustable wheel assembly into said engaged position when the distal end of the engaging member is selectively positioned away from the pole.

16. The portable basketball goal system as defined in claim 1, wherein said engaging member comprises a cam surface.

17. The portable basketball goal system as defined in claim 16, wherein said adjustable wheel assembly comprises a slider and a follower disposed along a length of said slider, said follower configured to protrude outward from the slider and engage said cam surface of said engaging member.

18. The portable basketball goal system as defined in claim 1, wherein said front portion of said support base comprises a receiving aperture adapted to receive at least a portion of said pole.

19. The portable basketball goal system as defined in claim 1, wherein said support base is capable of holding a ballast material.

20. The portable basketball goal system as defined in claim 1, wherein the adjustable wheel assembly is slidably attached to the support base.

21. The portable basketball goal system as defined in claim 1, further comprising at least one roller rotatably coupled to the base support, wherein the roller is spaced apart from the adjustable wheel assembly.

22. A portable basketball goal system, comprising:

a rigid pole configured to support of basketball goal above a playing surface;

a support base having a front portion, wherein the support base is adapted to receive and maintain said pole in a generally upward direction;

an adjustable wheel assembly comprising a slider having a leading end, an opposing end, and a length disposed between said leading and opposing ends, a follower connected along the length of said slider, and a caster rotably mounted at said leading end of the slider, said wheel assembly being adjustable between and an engaged position such that the caster selectively engages said playing surface and a disengaged position such that the caster is retracted from supportable engagement with the playing surface; and an engaging member pivotally connected to said support base and having a cam surface engageably disposed in relation to said follower of said adjustable wheel assembly, said engaging member configured to be positionable between an extended position such that the adjustable wheel assembly is correspondingly disposed in said engaged position to supportably remove said front portion of the support base from contact with said playing surface and a retracted position such that the adjustable wheel assembly is correspondingly disposed in said disengaged position wherein the front portion of the support base supportably engages the playing surface.

23. The portable basketball goal assembly as defined in claim 22, wherein said pole comprises at least two section member adapted to be telescopically disposed in relation to each other.

24. The portable basketball goal system as defined in claim 22, wherein said pole comprises a first end supportably engaging said basketball goal and a second opposing end pivotally connected to said support base.

25. The portable basketball goal system as defined in claim 24, wherein said second end of said pole comprises an internal channel having an internal periphery.

26. The portable basketball goal system as defined in claim 25, wherein said opposing end and a portion of said length of said slider is configured to be slidably introduced within said internal periphery of said internal channel of said pole.

27. The portable basketball goal system as defined in claim 22, wherein said caster is mounted to a swivel base.

28. The portable basketball goal system as defined in claim 22, wherein said slider of said adjustable wheel assembly comprises a substantially straight path of extension and retraction.

29. The portable basketball goal system as defined in claim 22, wherein said adjustable wheel assembly is disposed beneath said pole to directly support a weight thereof.

30. The portable basketball goal system as defined in claim 22, wherein said engaging member comprises a proximate end, a distal end, and an intermediate body portion formed between said proximate and distal ends, said proximate end pivotally attached to said support base.

31. The portable basketball goal system as defined in claim 30, wherein said distal end of said engaging member comprises a handle.

32. The portable basketball goal system as defined in claim 30, wherein said engaging member actuates said slider and caster of said adjustable wheel assembly into said disengaged position when said distal end of the engaging member is moved toward said pole, and wherein the engaging member actuates the slide and caster into said engaged position when the distal end of the engaging member is selectively positioned away from the pole.

33. The portable basketball goal system as defined in claim 22, wherein said front portion of said support base comprises a receiving aperture adapted to receive at least a portion of said pole.

34. The portable basketball goal system as defined in claim 22, wherein said support base is capable of holding a ballast material.

* * * * *

UNITED STATES PATENT AND TRADEMARK OFFICE

CERTIFICATE OF CORRECTION

PATENT NO. : 6,432,003 B1
DATED : August 13, 2002
INVENTOR(S) : Edward G. van Nimwegen It is certified that error appears in the above-identified patent and that said Letters Patent is hereby corrected as shown below:

Column 3,
Line 12, change “coal” to -- goal --
Line 45, before “guess” delete “(”

Column 4,
Line 2, after “being” delete “,”
Line 12, after “would” insert -- be --
Line 42, after “base” change “,” to -- . --

Column 5,
Line 8, delete “is”
Line 23, change “cain” to -- cam --
Line 62, after “then” insert -- be --

Column 8,
Line 51, after “itself” insert -- , --

Column 9,
Line 33, after “distal” insert -- end --
Line 58, change “tile” to -- the --
Line 60, change “fictional” to -- frictional --
Line 63, after “referring” delete “,”

Column 10,
Line 35, change “fictionally” to -- frictionally --
Line 35, change “tie” to -- the --
Line 51, change “configur ation” to -- configuration --
Line 51, change “shape” to -- shapes --
Line 54, after “22” change “in” to -- is --

Column 11,
Line 47, change “base support” to -- support base --

Column 12,
Line 39, change “pole support” to -- support pole --
Line 57, change “this” to -- thus --

Column 13,
Line 8, after “playing” delete “,”

UNITED STATES PATENT AND TRADEMARK OFFICE

CERTIFICATE OF CORRECTION

PATENT NO. : 6,432,003 B1
DATED : August 13, 2002
INVENTOR(S) : Edward G. van Nimwegen It is certified that error appears in the above-identified patent and that said Letters Patent is hereby corrected as shown below:

Column 14,
Line 12, change “of” to -- a --
Line 19, delete “and”

Column 15,
Line 43, change “of” to -- a --
Line 53, delete “and”

Column 16,
Line 13, change “member” to -- memebers --

Signed and Sealed this

Eleventh Day of February, 2003

JAMES E. ROGAN
*Director of the United States Patent and Trademark Office*